US006644279B1

(12) United States Patent
Frank et al.

(10) Patent No.: US 6,644,279 B1
(45) Date of Patent: Nov. 11, 2003

(54) HIGH PRESSURE RESERVOIR FOR FUEL

(75) Inventors: Kurt Frank, Schorndorf (DE); Steffen Jung, Leonberg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/806,677

(22) PCT Filed: Aug. 1, 2000

(86) PCT No.: PCT/DE00/02563

§ 371 (c)(1),
(2), (4) Date: Jun. 29, 2001

(87) PCT Pub. No.: WO01/09508

PCT Pub. Date: Feb. 8, 2001

(30) Foreign Application Priority Data

Aug. 3, 1999 (DE) ..... 199 36 534

(51) Int. Cl.[7] ..... F02M 55/02
(52) U.S. Cl. ..... 123/447; 123/456
(58) Field of Search ..... 123/456, 447, 123/468

(56) References Cited

U.S. PATENT DOCUMENTS

| | | | | |
|---|---|---|---|---|
| 4,474,159 A | | 10/1984 | Katnik | 123/468 |
| 4,570,602 A | * | 2/1986 | Atkins et al. | 123/468 |
| 4,823,754 A | * | 4/1989 | Minamoto et al. | 123/470 |
| 4,832,376 A | | 5/1989 | Sugao | 285/141.1 |
| 5,423,303 A | | 6/1995 | Bennett | 123/527 |
| 5,511,527 A | * | 4/1996 | Lorraine et al. | 123/456 |
| 5,513,613 A | * | 5/1996 | Taylor et al. | 123/456 |
| 5,595,160 A | | 1/1997 | Matsumoto et al. | 123/456 |
| 6,088,647 A | * | 7/2000 | Hemberger et al. | 123/478 X |

FOREIGN PATENT DOCUMENTS

| | | |
|---|---|---|
| DE | 196 40 480 | 4/1998 |
| DE | 197 53 977 | 6/1998 |
| DE | 198 08 807 | 9/1998 |
| DE | 198 08 894 | 9/1998 |
| EP | 0 132 418 | 1/1985 |
| JP | 10-299610 | * 11/1998 |

* cited by examiner

*Primary Examiner*—Tony M. Argenbright
(74) *Attorney, Agent, or Firm*—Kenyon & Kenyon

(57) ABSTRACT

A high-pressure fuel accumulator for a common-rail fuel injection system of an internal combustion engine includes a tubular main body which is equipped with a plurality of connections. In order to provide a high-pressure fuel accumulator which may be used for a large number of similar engines, a continuous connecting strip or several connections, whose dimensions in the longitudinal direction of the tubular main body are greater than the space required for connections, are provided on the tubular main body.

11 Claims, 2 Drawing Sheets

HIGH PRESSURE RESERVOIR FOR FUEL

FIELD OF THE INVENTION

The present invention relates to a high-pressure fuel accumulator for a common-rail fuel injection system of an internal combustion engine, having a tubular main piece which is equipped with a plurality of connections.

BACKGROUND INFORMATION

A high-pressure fuel accumulator is described, for example, in German Patent No. 196 40 480. In common-rail injection systems, a high-pressure pump, possibly with the assistance of a pre-supply pump, feeds fuel to be injected from a tank into the central high-pressure fuel accumulator, which is known as a common rail. Fuel lines lead from the rail to the individual injectors, which are associated with the cylinders of the internal combustion engine. The injectors are controlled individually by the electronic system of the engine, depending on the operating parameters of the internal combustion engine, in order to inject fuel into the combustion chamber of the internal combustion engine. The pressure generation and the injection are uncoupled from one another by the high-pressure fuel accumulator.

The rail known from German Patent No. 196 40 480 is made out of a precisely fitting forging blank. Different forging blanks are required for different versions of engines.

SUMMARY OF THE INVENTION

An object of the present invention is to provide a high-pressure fuel accumulator of the type described above, which can be used for a large number of similar engines, for example common four-cylinder engines. In addition, the high-pressure fuel accumulator according to the present invention is to have a simple design and be economical to manufacture.

In the case of a high-pressure fuel accumulator for a common rail fuel injection system of an internal combustion engine having a tubular main body, which is equipped with a plurality of connections, the object is achieved by the fact that a continuous connector block is made on the tubular main body. The connections can be made in the continuous connector block by a machining operation such as drilling. Any distance between the connections can be chosen. Therefore it is possible to use one forging blank for producing different rails for different versions of engines. The tooling costs required for producing the forging blank are considerably reduced in this way.

The object cited above in the case of a high-pressure fuel accumulator for a common rail fuel injection system of an internal combustion engine, having a tubular main body which is provided with a plurality of connections, is also achieved by the fact that several connections are provided on the tubular main body, their dimensions in the longitudinal direction of the tubular main body being greater than the space required for the connections. The connections can be made so wide that the position of the connections, for example made by a machining manufacturing process, is completely optional within the predefined width. In this way it is guaranteed that one forging blank can be used for producing different rails for different versions of engines. Thus the tooling costs required for producing the forging blank are reduced considerably.

The object cited above in the case of a high-pressure fuel accumulator for a common rail fuel injection system of an internal combustion engine, having a tubular main body which is provided with several connections, is also achieved by the fact that in each connection is provided in a connecting part which encloses the tubular main body and is situated in the area of an opening in the tubular main body. The opening can be made using a machining operation such as drilling at any location of the tubular main body. The separate connecting part can therefore also be provided at any location of the tubular main body. This provides the advantage that the high-pressure fuel accumulator according to the present invention can be assembled according to the modular principle. A highly flexible rail design is thus made possible. Many identical parts can be used. In addition, the materials of the different components can be chosen in accordance with load and manufacturing conditions. There is separation of the functions of high pressure accumulation and connection or distribution. The connecting part may be made as a forged, punched, or extruded part in large numbers as vendor parts.

In a specific embodiment of the present invention, the connecting part is attached using a clamp connection on the tubular main body. The clamp connection can be made detachable by a screw connection. Instead of the screw connection the clamp connection also can be made as a riveted, shrunk-on, or welded connection.

In a further specific embodiment of the present invention, at least one fastening flange enclosing the tubular main body is fixedly clamped to the tubular main body with a fastening strap. The fastening strap is used for fastening the high-pressure fuel accumulator to the internal combustion engine.

In a further specific embodiment of the present invention, the connector block or the connections are forged onto the tubular main body. In this way the high-pressure strength and the service life of the high-pressure fuel accumulator are increased.

In a further specific embodiment of the present invention, several fastening straps are welded onto the tubular main body. Welding the fastening straps provides the advantage that the position of the fastening flanges or the installation points is freely selectable.

In a further specific embodiment of the present invention, the tubular main body has a blind hole running in the longitudinal direction, whose open end is closed by a pressure sensor. This provides the advantage that no additional high-pressure sealing of the pressure sensor is necessary. A sealing plug for the open end of the blind hole can be omitted.

In a further specific embodiment of the present invention, the pressure sensor is surrounded by a protective sleeve. The protective sleeve is used for protecting the pressure sensor against mechanical damage. The protective sleeve may be made in one piece or in two pieces.

DETAILED DESCRIPTION

Figure 1:
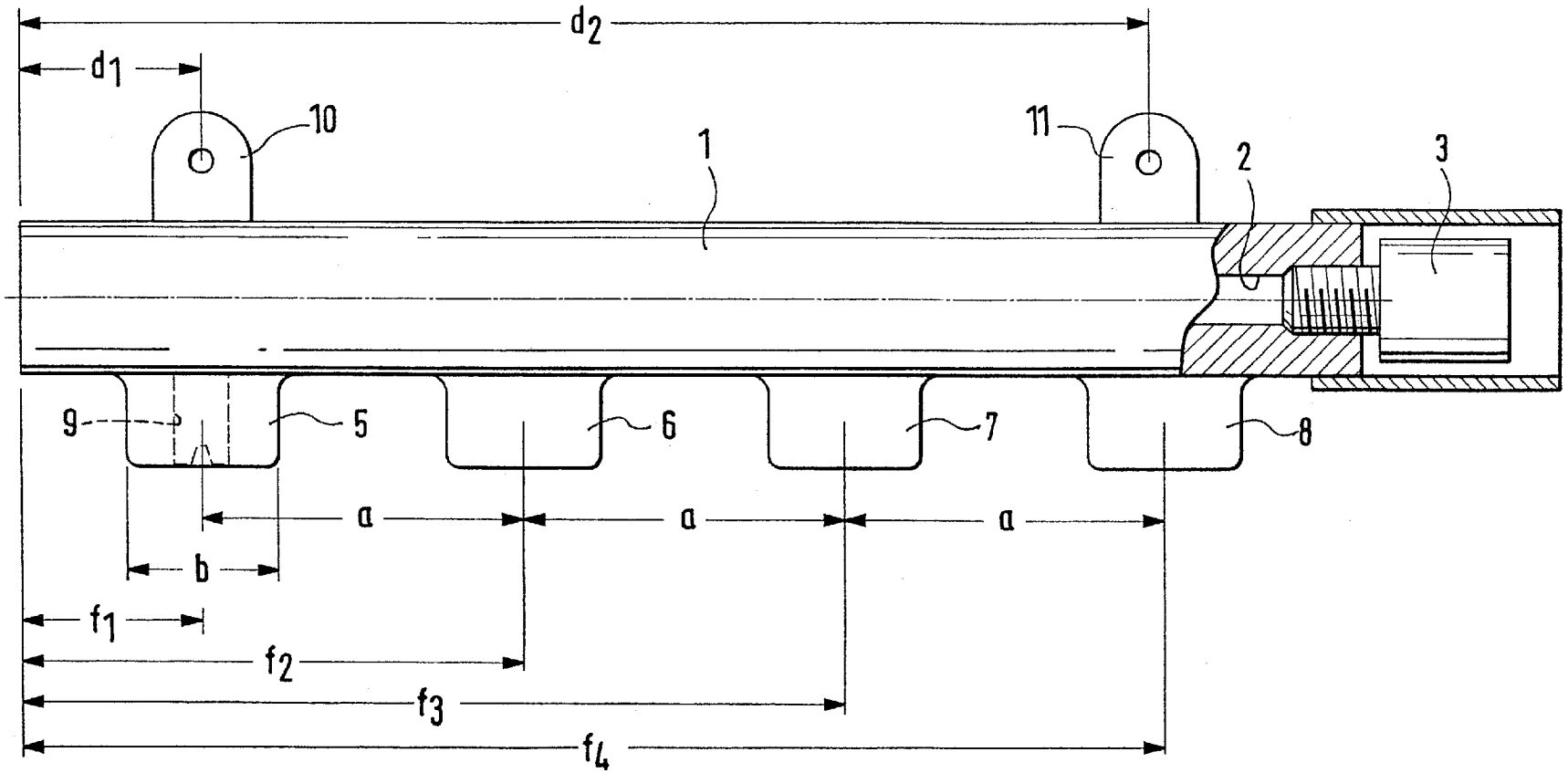
FIG. 1 shows a partial longitudinal section of a first embodiment of a high-pressure fuel accumulator according to the present invention.

A longitudinal section of a first embodiment of a high-pressure fuel accumulator according to the present invention is shown in FIG. 1. The high-pressure fuel accumulator shown includes a tubular main body 1. A blind hole 2 is provided in tubular main body 1 in the longitudinal direction. Blind hole 2 forms the accumulator volume of the high-pressure fuel accumulator. The open end of blind hole 2 is closed with a rail pressure sensor 3. Rail pressure sensor 3 is surrounded by a protective sleeve 4, which has the shape of a hollow cylinder.

Four connections 5, 6, 7, and 8 are located on the outside of tubular main body 1. A connecting hole is provided in each of connections 5 to 8. For example, a connecting hole 9 is shown in connection 5. As is seen in FIG. 1, the diameter of connecting hole 9 in connection 5 is much smaller than width b of connection 5. This makes it possible to position connecting hole 9 at different locations on connection 5.

The separation of the individual connecting holes in connections 5 to 8 from one another is indicated as a. In the present example, all connecting holes have the same distance a from one another. The distances of the center lines of connecting holes in connections 5 to 8 from the closed end of tubular main body 1 are indicated as $f_1$, $f_2$, $f_3$, and $f_4$.

Tubular main body 1 shown in FIG. 1 is a forged part. Connections 5 to 8 are forged onto tubular main body 1. The width of forged-on connections 5 to 8 is such that positions $f_1$, $f_2$, $f_3$, and $f_4$ of injector connections 5 to 8 made by machining are freely optional within width b. Thus the forging blank can be used universally for common cylinder spacings (for example in regular four-cylinder engines). The extreme case is a continuous forged-on strip instead of individual connections 5 to 8.

Two fastening straps 10 and 11 are welded on tubular main body 1 on the side opposite connections 5 to 8. The distances of fastening straps 10 and 11 from the closed end of tubular main body 1 are indicated as $d_1$ and $d_2$. The position of welded-on fastening straps 10 and 11 is freely selectable depending on the engine to be assembled.

Figure 2:
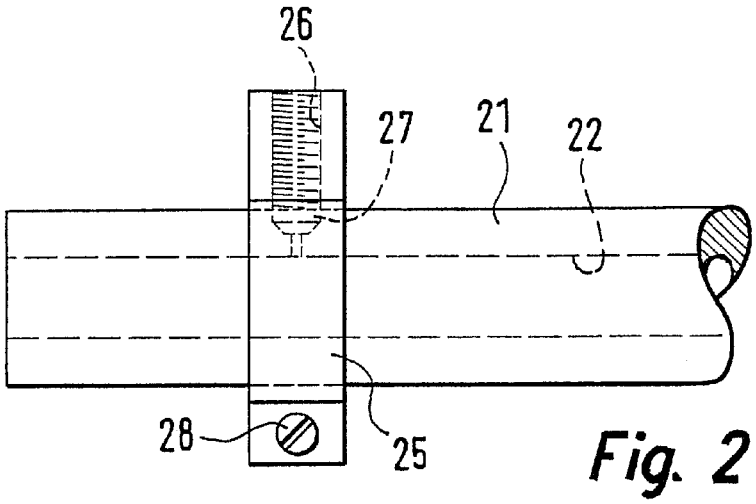
FIG. 2 shows a section of a second embodiment of a high-pressure fuel accumulator according to the present invention having a connecting part.

FIG. 2 shows a second embodiment of a high-pressure fuel accumulator according to the present invention. A longitudinal hole 22 is located in a tubular main body 21 shown only sectionally. A separate connecting part 25 is clamped tight to a section of tubular main body 21 using a screw connection 28. The connection between connecting part 25 and tubular main body 21 also can be made by shrinking, riveting, or welding. Connecting part 25 may be made as a forged, punched, or extruded part in large numbers as vendor parts.

The position of connecting part 25 on tubular main body 21 is freely selectable and not bound to a forged blank. Connecting part 25 encloses tubular main body 21. A connecting hole 26 having an internal thread for assembly of injection lines or sensors or valves is made in connecting part 25, as is indicated at 26. Connecting hole 26 is connected with longitudinal hole 22 in tubular main body 21 via an opening 27 in tubular main body 21. A separating flange is provided on the side of connecting part 25 opposite to connecting hole 26, for attachment to tubular main body 21.

Figure 3:
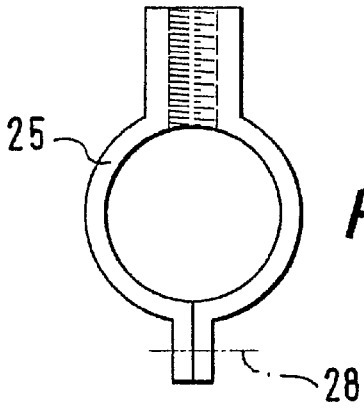
FIG. 3 shows a side view of the connecting part from FIG. 2 in a separate representation.

A side view of connecting part 25 is seen in FIG. 3 in a separate representation. The clamping force required for fastening connecting part 25 on tubular main body 21 is produced by screw connection 28.

Figure 4:
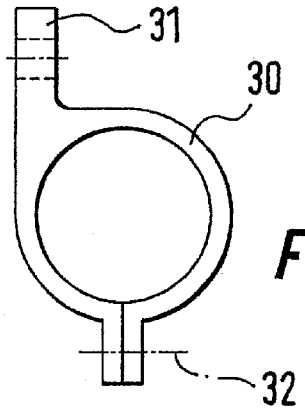
FIG. 4 shows a side view of a fastening flange.

FIG. 4 shows a fastening flange 30, which resembles connecting part 25. A fastening strap 31, which is used for fastening the high-pressure fuel accumulator according to the present invention to the internal combustion engine, is provided on fastening flange 30. Fastening flange 30 is clamped tight to tubular main body 21 exactly as connecting part 25. The clamping force required for clamping is provided by a screw connection 32.

What is claimed is:

1. A high-pressure fuel accumulator for a common-rail fuel injection system of an internal combustion engine, comprising:

a tubular main body having a plurality of connections; and a continuous connector block situated on the tubular main body; and a pressure sensor;

wherein the tubular main body has a blind hole extending in a longitudinal direction, the pressure sensor closing an open end of the hole.

2. The high-pressure fuel accumulator according to claim 1, wherein the plurality of connections includes connections having dimensions in a longitudinal direction of the tubular main body that are greater than a space required for the connections.

3. The high-pressure fuel accumulator according to claim 1, wherein the connections are forged onto the tubular main body.

4. The high-pressure fuel accumulator according to claim 3, wherein the connections are in the form of a connecting strip.

5. The high-pressure fuel accumulator according to claim 3, further comprising a plurality of fastening strips welded onto the tubular main body.

6. The high-pressure fuel accumulator according to claim 1, further comprising a protective sleeve surrounding the pressure sensor.

7. The high-pressure fuel accumulator according to claim 2, wherein the connections are forged onto the tubular main body.

8. The high-pressure fuel accumulator according to claim 7, wherein the connections are in the form of a connecting strip.

9. The high-pressure fuel accumulator according to claim 7, further comprising a plurality of fastening strips welded onto the tubular main body.

10. A high-pressure fuel accumulator for a common-rail fuel injection system of an internal combustion engine, comprising:

a tubular main body having connections situated thereon, the connections having dimensions in a longitudinal direction of the tubular main body that are greater than a space required for the connections; and a pressure sensor;

wherein the tubular main body has a blind hole extending in a longitudinal direction, the pressure sensor closing an open end of the hole.

11. The high-pressure fuel accumulator according to claim 10, further comprising a protective sleeve surrounding the pressure sensor.

* * * * *